US007722060B1

(12) United States Patent
Clark

(10) Patent No.: US 7,722,060 B1
(45) Date of Patent: May 25, 2010

(54) TRUCK ASSEMBLY FOR WHEELED RECREATIONAL DEVICE

(75) Inventor: Dustin Clark, Monroe, NC (US)

(73) Assignee: Disruptive Distribution, Inc., Charlotte, NC (US)

( * ) Notice: Subject to any disclaimer, the term of this patent is extended or adjusted under 35 U.S.C. 154(b) by 87 days.

(21) Appl. No.: 11/893,334

(22) Filed: Aug. 15, 2007

(51) Int. Cl.
*B62M 1/00* (2006.01)

(52) U.S. Cl. ..... 280/87.042; 280/11.27; 280/11.28

(58) Field of Classification Search ..... 280/87.042, 280/11.28, 11.27, 809; 411/190, 166, 167, 411/373; 29/437, 436, 453
See application file for complete search history.

(56) References Cited

U.S. PATENT DOCUMENTS 2,513,037 A * 6/1950 McLaughlin ..... 411/166
2,933,006 A * 4/1960 Gibb ..... 411/373
4,140,326 A * 2/1979 Huber ..... 280/87.042
4,199,165 A * 4/1980 Spitzke ..... 280/87.042
4,245,848 A * 1/1981 Dudouyt ..... 280/11.28
5,068,956 A * 12/1991 Malewicz ..... 280/11.27
5,263,725 A * 11/1993 Gesmer et al. ..... 280/11.28
5,474,314 A * 12/1995 Lehman ..... 280/87.042
5,984,328 A * 11/1999 Tipton ..... 280/87.042
6,199,880 B1 * 3/2001 Favorito et al. ..... 280/87.042
6,343,803 B1 * 2/2002 Johnston ..... 280/87.042
7,007,977 B1 * 3/2006 Gallagher ..... 280/809
7,121,566 B2 * 10/2006 McClain ..... 280/87.042

* cited by examiner

*Primary Examiner*—Hau V Phan
(74) *Attorney, Agent, or Firm*—Schwartz Law Firm, P.C.

(57) ABSTRACT

A truck assembly is used in a wheeled recreational device including a base plate and hanger. The base plate defines a plurality of mounting holes adapted for receiving respective threaded bolts, and further defines a corresponding plurality of fastener retention regions surrounding respective mounting holes. Each fastener retention region includes point-engaging structure adapted for engaging at least two points of a multi-point threaded nut, such that the point-engaging structure substantially prevents rotation of the threaded nut upon mating attachment of a corresponding threaded bolt. The hanger resides adjacent to the base plate, and includes a wheel axle adapted for carrying at least one wheel of the recreational device.

7 Claims, 8 Drawing Sheets

TRUCK ASSEMBLY FOR WHEELED RECREATIONAL DEVICE

TECHNICAL FIELD AND BACKGROUND

The invention in its exemplary embodiments described herein relates broadly to a truck assembly for a wheeled recreational device, such as a skateboard. The truck assembly incorporates novel features and components including, for example, an improved base plate. In one exemplary implementation, the novel base plate is designed to facilitate mounting of the truck assembly to an underside of the skateboard deck.

SUMMARY OF EXEMPLARY EMBODIMENTS

Various exemplary embodiments of the invention are described below. Use of the term "exemplary" means by way of example only; and any reference herein to "the invention" corresponds to the various embodiments contemplated either expressly or implicitly by the present disclosure, and is not intended to limit or restrict the claimed subject matter to the exact features, components and structures disclosed herein.

Accordingly, it is one object of the invention to facilitate mounting of a truck assembly to the underside of a skateboard deck.

It is another object of the invention to provide convenient means for holding a fastener to the base plate of the truck assembly during attachment of the truck assembly to the skateboard or other wheeled recreational device.

It is another object of the invention to provide convenient means for preventing, or substantially limit, rotation of the fastener relative to the base plate during attachment of the truck assembly to the skateboard or other wheeled recreational device.

It is another object of the invention to provide an improved base plate applicable to any wheeled recreational device and other unrelated device requiring the use of threaded fasteners.

It is another object of the invention to reduce the number of tools required to assemble the truck assembly of a skateboard or other wheeled recreational device.

These and other objects are achieved in the exemplary embodiments disclosed below by providing a truck assembly for use in a wheeled recreational device incorporating a base plate and truck hanger. The base plate defines a plurality of mounting holes adapted for receiving respective threaded bolts, and further defines a corresponding plurality of fastener retention regions surrounding respective mounting holes. Each fastener retention region includes point-engaging structure adapted for engaging at least two points of a multi-point threaded nut, such that the point-engaging structure substantially prevents rotation of the threaded nut upon mating attachment of a corresponding threaded bolt. The hanger resides adjacent to and may be partially received into the base plate, and includes a wheel axle adapted for carrying at least one wheel of the recreational device.

The term "hanger" is used broadly herein to mean any depending structure' which defines an axle for carrying one or more wheels.

According to another exemplary embodiment, the point-engaging structure of the fastener retention region includes a plurality of raised intersecting walls. In this embodiment, the raised intersecting walls form at least a partial socket designed to closely receive the threaded nut. Alternatively, the point-engaging structure may comprise, for example, multiple pins, shoulders, or any other means for locking the threaded nut against rotational movement.

According to another exemplary embodiment, the intersecting walls define a side fastener access to the fastener retention region.

According to another exemplary embodiment, an arcuate groove is formed with the plurality of intersecting walls at the fastener access to the fastener retention region. The arcuate groove is adapted for receiving a flange portion of the threaded nut, and may serve to hold the threaded nut in place prior to attachment of the complementary-threaded bolt. Alternatively, prior to attachment of the bolt, the nut may be held to the base plate using a magnetic surface, adhesive, tacky coating, or the like.

According to another exemplary embodiment, the arcuate groove is defined by at least one arcuate, chamfered edge. The term "chamfered" means being cut at an angle other than 90 degrees to a referenced surface.

According to another exemplary embodiment, a kingpin secures the hanger to the base plate. In alternative embodiments, other means (not including a kingpin) may be used to secure the hanger to the base plate.

According to another exemplary embodiment, a kingpin nut may be applied to the kingpin and adapted for adjusting a turning capacity of the truck assembly. Alternatively, the kingpin may insert into an internally-threaded hole formed with the base plate or deck.

According to another exemplary embodiment, at least one bushing is carried on the kingpin. Alternatively, other means (e.g., springs) may be utilized instead of bushings.

According to another exemplary embodiment, a pivot cup resides adjacent the baseplate and supports the hanger at a pivot point of the truck assembly.

According to another exemplary embodiment, at least one wheel is mounted on the axle.

In another exemplary embodiment, the invention comprises a wheeled recreational device including a deck, a truck assembly, and at least one wheel. The truck assembly is mounted to the deck, and includes a base plate, and a hanger residing adjacent to the base plate. The hanger includes a wheel axle. The base plate defines a plurality of mounting holes adapted for receiving respective threaded bolts; and further defines a corresponding plurality of fastener retention regions surrounding respective mounting holes. Each fastener retention region comprises point-engaging structure adapted for engaging at least two points of a multi-point threaded nut, such that the point-engaging structure substantially prevents rotation of the threaded nut upon mating attachment of a corresponding threaded bolt. At least one wheel is mounted on the axle.

The term "deck" is used broadly herein to mean any supporting surface, platform, or other structure to which a truck assembly may be mounted. The term "truck assembly" refers broadly to any structure comprising at least an axle designed for mounting one or more wheels.

According to another exemplary embodiment, the recreational device may comprise a skateboard. Alternatively, the recreational device may include other wheeled devices such as roller skates, Rollerblades®, scooters, or the like.

In yet another exemplary embodiment, the invention comprises a base plate for a wheeled recreational device or any other application. The base plate includes at least one bolt hole, and at least one fastener retention region surrounding the bolt hole. The fastener retention region includes point-engaging structure adapted for engaging at least two points of a multi-point threaded fastener, such that the point-engaging structure substantially prevents rotation of the threaded fastener upon mating attachment of a complementary threaded fastener.

BRIEF DESCRIPTION OF THE DRAWINGS

The description of exemplary embodiments proceeds in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Like numbers refer to like elements throughout. As used herein, the article "a" is intended to include one or more items. Where only one item is intended, the term "one" or similar language is used. Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. Any references to advantages, benefits, unexpected results, or operability of the present invention are not intended as an affirmation that the invention has been previously reduced to practice or that any testing has been performed.

Figure 1:
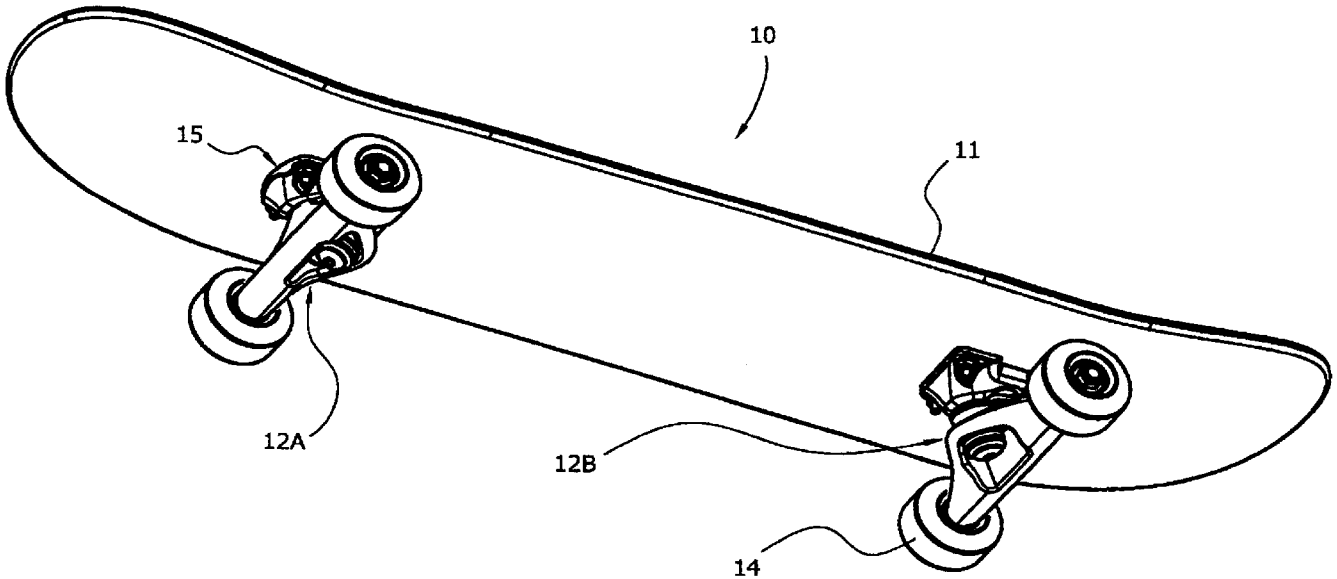
FIG. 1 is a perspective view of a wheeled recreational device according to one exemplary embodiment of the present invention.

Referring now specifically to the drawings, a skateboard incorporating features and components according to exemplary embodiments of the present invention is illustrated in FIG. 1 and shown generally at reference numeral 10. In the embodiment shown, the skateboard incorporates a substantially flat rigid deck 11 comprising front and rear kicktails, and spaced-apart truck assemblies 12A and 12B; each truck assembly including a pair of rotatably mounted wheels 14.

The skateboard deck 11 is typically constructed of multiple laminated wood plies, and may be formed in a variety of shapes, sizes, weights, and strengths. The front and rear kicktails may be slightly raised. The truck assemblies 12A, 12B are mounted to the underside of the deck 11, as described below.

Truck Assembly 12A

Figure 2:
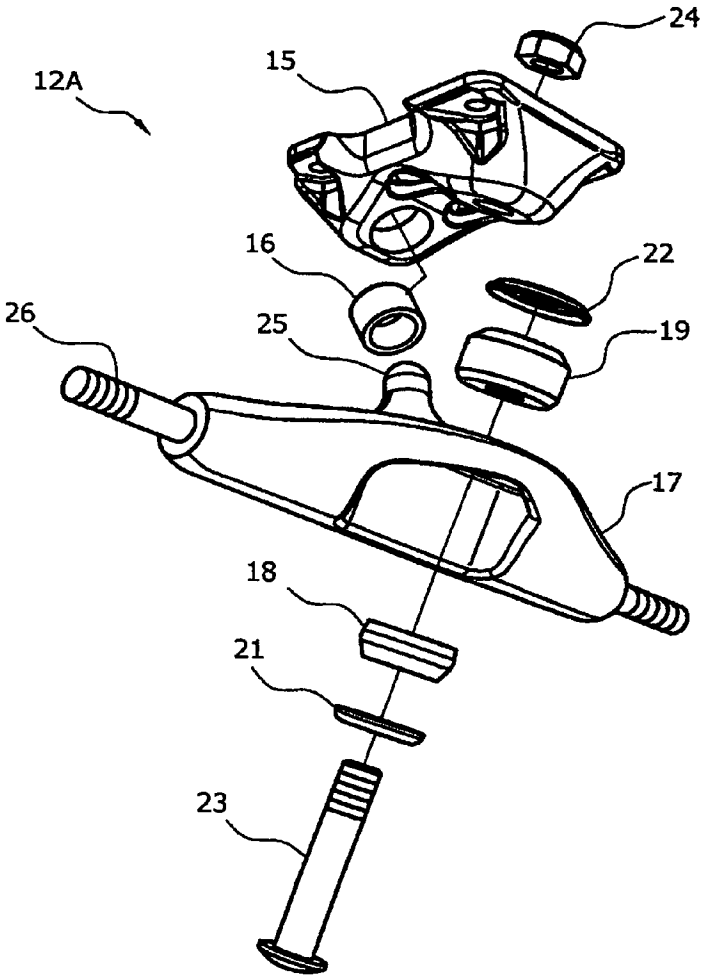
FIG. 2 is an exploded perspective view of the truck assembly.
Figure 3:
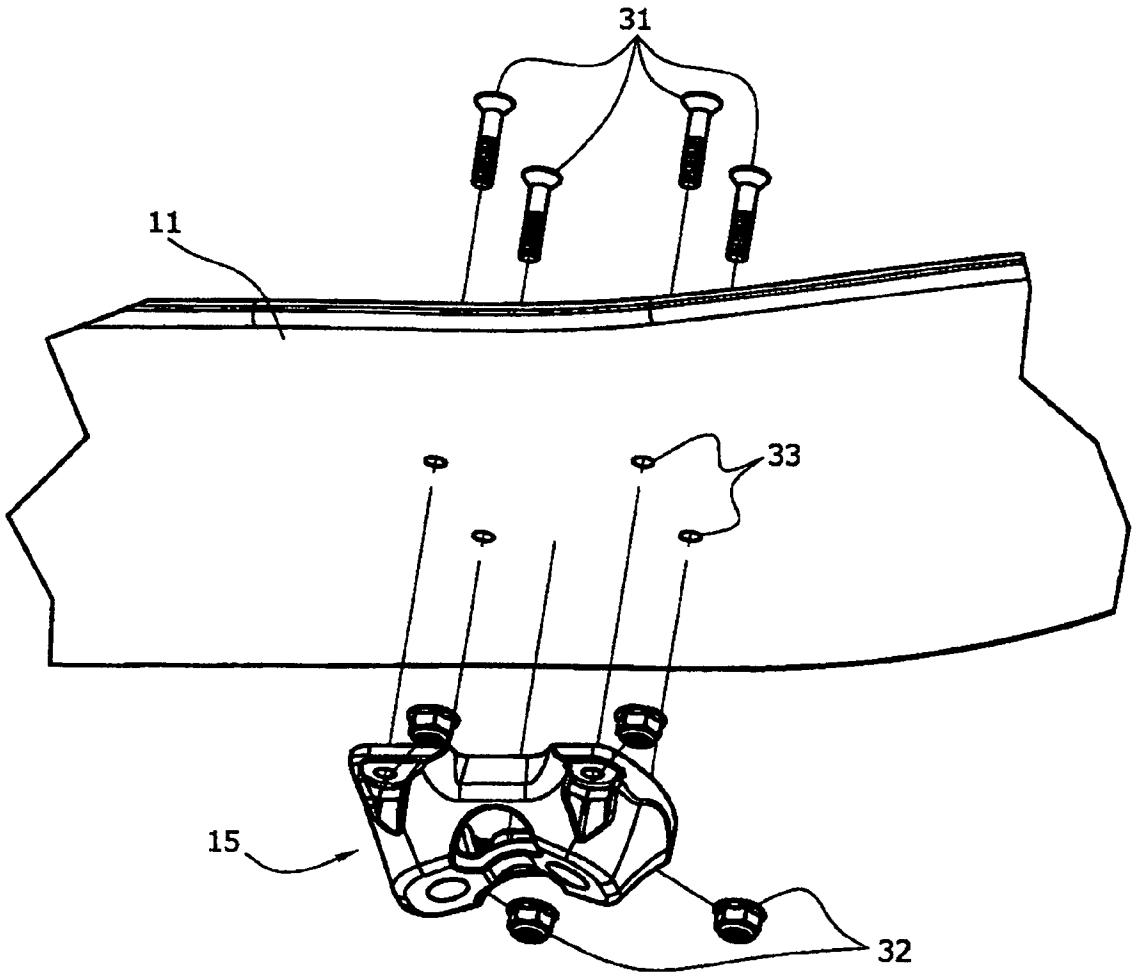
FIG. 3 is a fragmentary perspective view of the wheeled recreational device with the base plate and mounting hardware exploded away.
Figure 4:
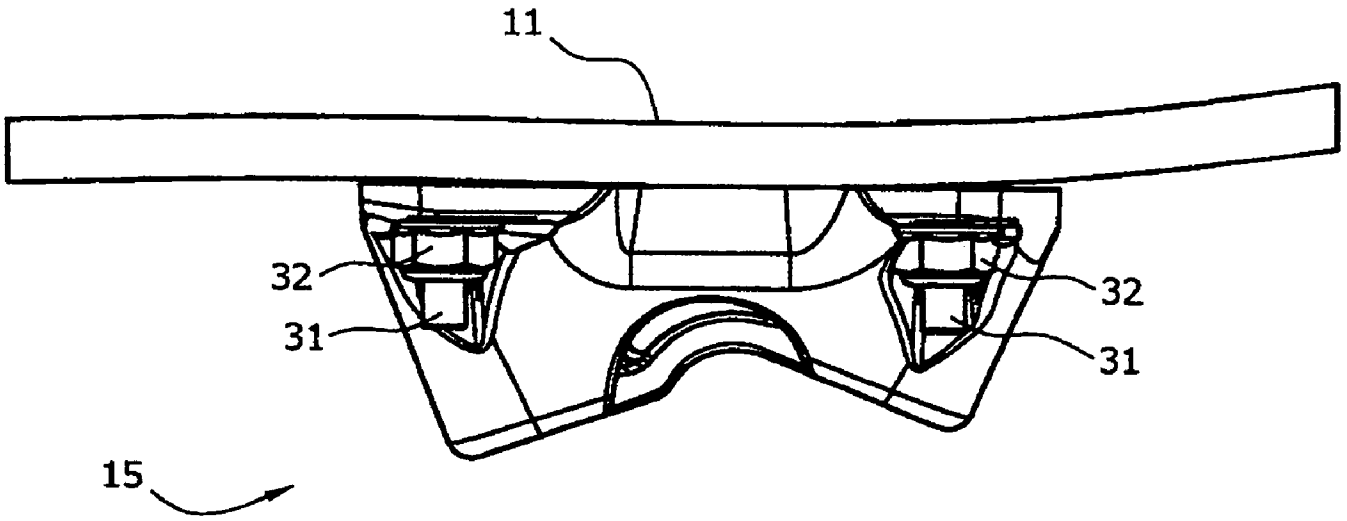
FIG. 4 is a side view of the base plate mounted to the underside of the deck.

Referring to FIGS. 1 and 2, the spaced-apart truck assemblies 12A, 12B of the skateboard 10 comprise substantially identical components. As such, the truck assembly 12A and its component parts are described below—this disclosure also applying to truck assembly 12B.

As best shown in FIG. 2, in one exemplary embodiment, the truck assembly 12A comprises a rigid (e.g., aluminum alloy) base plate 15, pivot cup 16, truck hanger 17, replaceable bushings 18, 19, cup washers 21, 22, threaded kingpin 23, and complementary-threaded kingpin nut 24. The base plate 15 is described further below. Additionally, the truck assembly 12A may utilize risers and shock pads (not shown) inserted between the base plate 15 and deck 11. The shock pads help prevent the deck 11 from developing stress cracks, while risers add height to the skateboard 10 and are especially applicable when using larger wheels.

The pivot cup 16 is a typically plastic, cup-shaped insert that rests inside the baseplate 15 and supports the truck hanger 17 at pivot point 25, allowing it to turn smoothly in either left or right directions. The truck hanger 17 is a substantially triangular (or T-shaped) part typically constructed of an aluminum alloy or other metal, and defining openings for receiving the kingpin 23 and wheel axle 26. The wheel axle 26 is typically constructed of stainless steel or other rigid metal. The kingpin 23 comprises a relatively large, threaded metal bolt which extends through the center of the upper and lower bushings 18, 19 and cup washers 21, 22, and cooperates with the kingpin nut 24 to secure the truck hanger 17 to the base plate 15. The stiffness of the truck assembly 12A may be adjusted by tightening and loosening the kingpin nut 24, thereby adjusting the turning capacity of the truck assembly 12A. The wheels 14, shown in FIG. 1, and bearings (not shown) are located on respective ends of the axle 26. The wheels 14 may be constructed of urethane, and may range in size from 45-60 mm.

Base Plate 15

Figure 5:
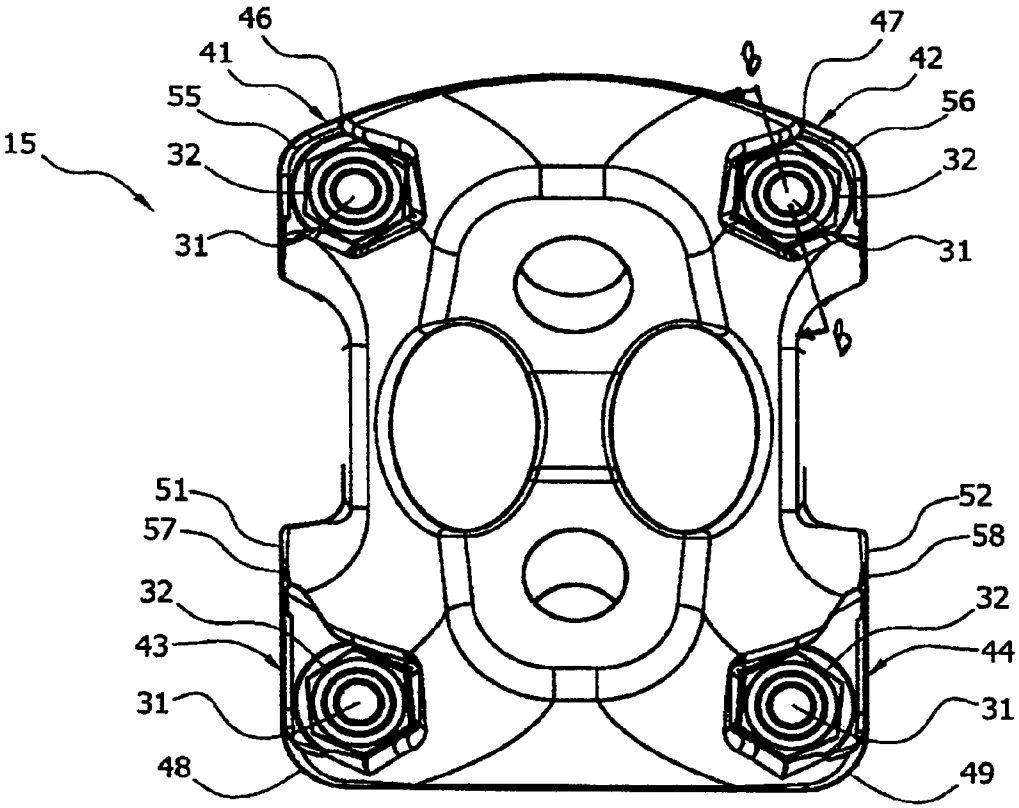
FIG. 5 is a plan view of the base plate.
Figure 6:
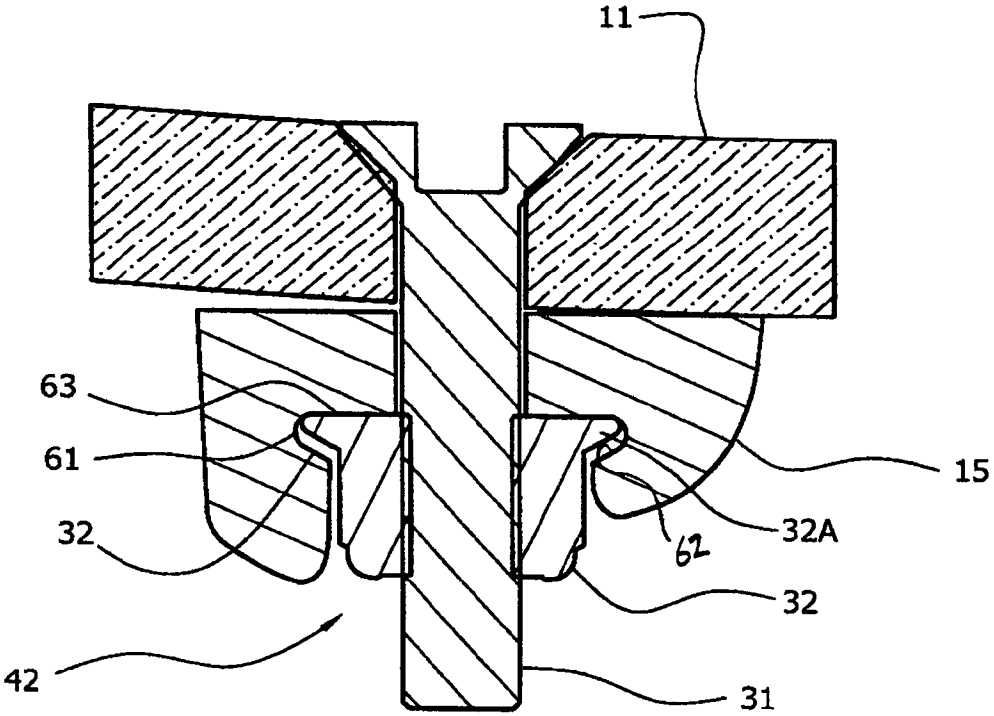
FIG. 6 is an enlarged cross-sectional view of the base plate taken substantially, along line B-B of FIG. 5.
Figure 7:
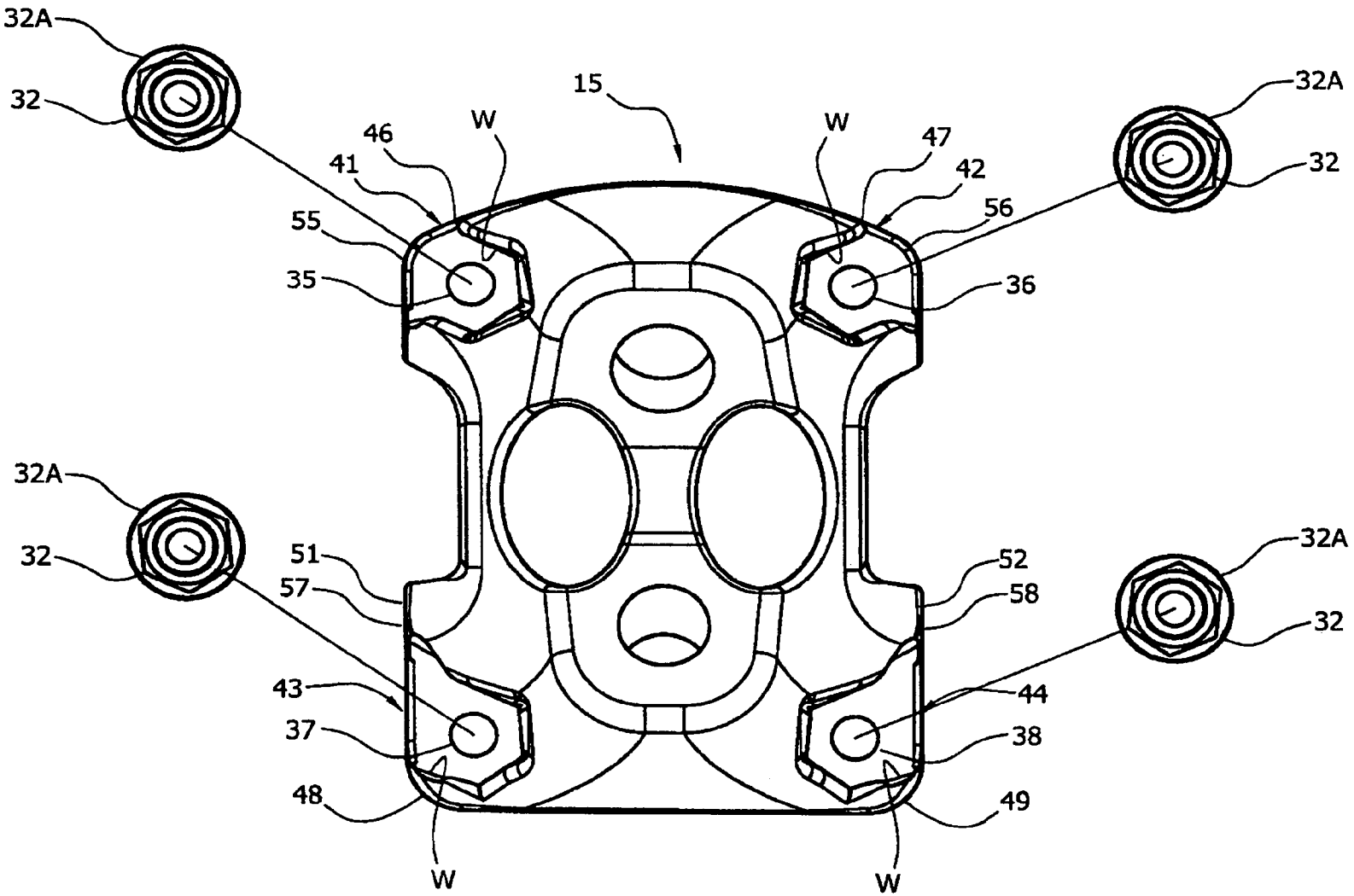
FIG. 7 is a plan view of the base plate with the mounting nuts removed from respective fastener retention regions.
Figure 8:
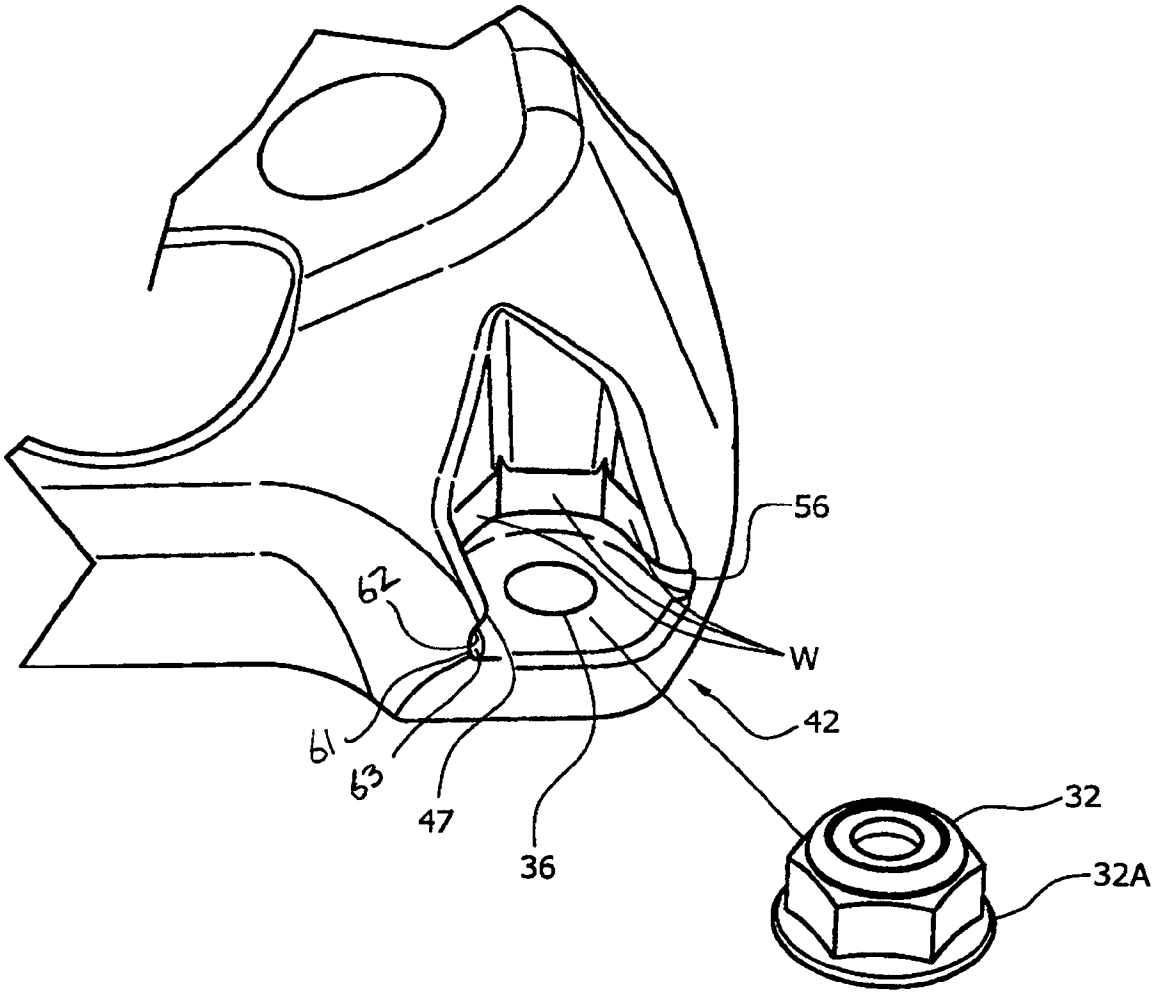
FIG. 8 is an enlarged, fragmentary, perspective view of a corner portion of the base plate with the threaded nut removed from the fastener-retention region.

Referring to FIGS. 3-8, the metal base plate 15 of each truck assembly 12A, 12B is mounted to the underside of the skateboard deck 11, as indicated above, using complementary-threaded fasteners, such as hex bolts 31 and flanged hex nuts 32. The bolts 31 pass through respective mounting holes 33 formed with the deck 11, and may have respective countersunk or undercut heads which locate at or below the top surface of the deck 11 (See FIG. 6). As shown in FIG. 7, the base plate 15 defines an arrangement of spaced mounting holes 35, 36, 37, and 38 adapted to align with the deck holes 33, and a corresponding number of fastener retention regions 41, 42, 43, and 44 surrounding respective mounting holes 35, 36, 37, and 38. The fastener retention regions 41-44 comprise integrally-formed, raised intersecting walls "W" (FIGS. 7 and 8) located at the leading corners 46, 47 and trailing corners 48, 49 of the base plate 15. As best shown in FIG. 8, the raised walls "W" at each region 41-44 cooperate to form a multi-sided, protective nut socket designed to receive and capture the flanged hex nut 32. In the embodiment shown, each region 41-44 comprises four raised intersecting walls—the walls being angled to substantially match the angle of a corresponding four sides of the hex nut 32. Additionally, respective lines of entry into the fastener-retention regions 41-44 may be slightly angled at angles other than 90 degrees to the sides 51, 52, such that the nuts 32 remain in place when the base plate 15 is held substantially vertically (i.e., with its longitudinal axis vertically disposed).

As best shown in FIGS. 5 and 7, the fastener retention regions 41-44 may be open at leading corners 46, 47 of the base plate 15 and at sides 51, 52 proximate the trailing corners 48, 49. The openings define respective side fastener accesses 55, 56, 57 and 58 for receiving the flange nuts 32. Referring to FIGS. 6 and 8, in each fastener retention region 41-44 (region 42 shown), the base of the intersecting walls "W" defines a chamfered arcuate groove 61 designed to accommodate the annular flange 32A of the flange nut 32. In the embodiment shown, the chamfered edge 62 is formed at an angle of approximately 30 degrees relative to an inside surface 63 at the fastener retention region 42. When located in the fastener retention regions 41-44, as many as four adjacent sides of the flange nuts 32 reside closely adjacent the raised intersecting walls "W", as shown in FIG. 5. In this position, the points of the nut 32 engage the intersecting walls "W" to prevent rotation upon mating attachment of each bolt 31 as the bolt 31 is passed through the deck 11 and base plate 15 and rotated into the nut 32. The annular flange 32A of the nut 32 engages the base plate 15 at the arcuate groove 61 (See FIG. 6) to hold and support the nut 32, and prevent it from accidentally dropping out of the fastener retention region 41-44 as the complementary fasteners are connected together. As an alternative to nut 32, the truck assemblies 12A, 12B may utilize a standard hex nut with a separately attached rubber, plastic, or metal washer; the washer defining an annular flange which may function in a manner similar to that described above.

In an alternative embodiment (not shown), the base plate may be secured to the skateboard deck using hex-head, flat head, or Phillips head bolts. In this embodiment, each bolt head resides within a fastener retention region while its threaded free end extends outwardly into a mounting hole formed with the skateboard deck to mate with a complementary-threaded nut or other fastener.

Exemplary embodiments of the present invention are described above. No element, act, or instruction used in this description should be construed as important, necessary, critical, or essential to the invention unless explicitly described as such. Although only a view of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the following claims. In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

I claim:

1. A truck assembly for use in a wheeled recreational device, comprising:

a base plate defining a plurality of mounting holes adapted for receiving respective threaded bolts therethrough, and further defining a corresponding plurality of fastener retention regions surrounding respective mounting holes, each fastener retention region comprising point-engaging structure including a plurality of raised intersecting walls adapted for engaging at least two points of a multi-point threaded flange nut, and said raised intersecting walls defining a fastener access to said fastener retention region, whereby said point-engaging structure substantially prevents rotation of the threaded flange nut upon mating attachment therewith of a corresponding threaded bolt;

a fastener-holding arcuate groove formed with said plurality of raised intersecting walls at the fastener access to said fastener retention region, said arcuate groove adapted for receiving a flange portion of the threaded flange nut; and a hanger residing adjacent to said base plate, and comprising a wheel axle adapted for carrying at least one wheel of the recreational device.

2. A truck assembly according to claim 1, wherein said arcuate groove is defined by at least one arcuate, chamfered edge.

3. A truck assembly according to claim 1, and comprising a kingpin securing said hanger to said base plate.

4. A truck assembly according to claim 3, and comprising a kingpin nut applied to said kingpin and adapted for adjusting a turning capacity of said truck assembly.

5. A truck assembly according to claim 4, and comprising at least one bushing carried on said kingpin.

6. A truck assembly according to claim 5, and comprising a pivot cup residing adjacent said baseplate and supporting said hanger at a pivot point of said truck assembly.

7. A truck assembly according to claim 1, and comprising at least one wheel mounted on said axle.

* * * * *